United States Patent [19]

Swanson

[11] 4,018,572

[45] Apr. 19, 1977

[54] DESULFURIZATION OF FOSSIL FUELS

[76] Inventor: Rollan Swanson, 220 California Ave., Santa Monica, Calif. 90403

[22] Filed: June 23, 1975

[21] Appl. No.: 589,412

[52] U.S. Cl. ..... 44/1 R; 201/17; 208/11 R; 208/230; 423/242

[51] Int. Cl.[2] ..... C10L 9/10; C10G 19/00

[58] Field of Search ..... 44/1 R, 76; 201/17; 208/230; 423/220, 242, 577, 210.5

[56] References Cited

UNITED STATES PATENTS

| | | | |
|---|---|---|---|
| 2,020,661 | 11/1935 | Schulze et al. | 208/230 |
| 2,162,221 | 6/1939 | Kasehagen et al. | 44/1 R |
| 3,617,529 | 11/1971 | Thompson et al. | 208/230 |
| 3,787,315 | 1/1974 | Bearden, Jr. et al. | 208/230 |
| 3,843,771 | 10/1974 | Urban | 423/514 |
| 3,848,056 | 11/1974 | Fonseca | 423/210.5 |

*Primary Examiner*—Carl F. Dees
*Attorney, Agent, or Firm*—Albert F. Kronman

[57] ABSTRACT

Coal and petroleum oils, flue gases produced by their combustion, and natural gases are desulfurized by reacting with sulfides or polysulfides of hydrogen, sodium, potassium, rubidium or cesium to form the higher sulfur content polysulfides of these metals. After these sulfides have acquired sufficient sulfur in combined form to form sulfur saturated polysulfides, they can be reduced to sulfur unsaturated forms with recovery of elemental sulfur. In their sulfur unsaturated form, these metal polysulfides are used to treat additional quantities of the fossil fuels.

The metal sulfides or polysulfides can be used in 1 to 12% aqueous solution or in melt condition. Hydrogen polysulfides are used in their liquid form.

Sulfur removal from the fossil fuels takes place by dissolving and/or reacting elemental sulfur, many organic sulfur forms, and water-insoluble metal sulfides in aqueous solutions of alkali metal sulfides or in melts of alkali metal sulfides.

11 Claims, No Drawings

DESULFURIZATION OF FOSSIL FUELS

BACKGROUND OF THE INVENTION

This invention relates to a process for desulfurizing fossil fuels such as coal or oil by reacting such fuels with a non-volatile agent which removes much of the sulfur and produces a compound which can be recycled after its decomposition into non-polluting sulfur and the reconstituted original agent, and by reduction of the sulfur content of fossil fuels prior to their combustion by means of alkali metal sulfides in either melt conditions or in aqueous solution followed by thermal decomposition of the resulting higher sulfur content polysulfide into non-polluting sulfur and a lower sulfur content polysulfide.

Environmental considerations have led to a legislation requiring the removal of sulfur from fuels prior to their combustion. Such removal heretofore has been accomplished by several methods which add appreciably to the cost of the fuels and present problems in disposal of the reagents produced in this desulfurization. Such costs and disposal problems are reduced when desulfurization is practiced by means of easily recycled reagents.

The main object of this invention therefore is to provide a process for desulfurizing fossil fuels by means of such reagents.

SUMMARY OF THE INVENTION

The process of the invention whereby the foregoing object is attained comprises contacting the fossil fuels with a sulfur compound which is a non-volatile sulfur unsaturated sulfide or polysulfide of the alkali metals or with hydrogen polysulfides. The unsaturated sulfides or polysulfides of the alkali metals will dissolve elemental sulfur, will remove sulfur from many organic compounds, dissolve certain water insoluble metal sulfides and form higher sulfur content alkali metal polysulfides. The form considered to be sulfur saturated for sodium is the tetrasulfide, for potassium it is the pentasulfide, for cesium and rubidium the hexasulfide. Though additional sulfur will dissolve in these saturated forms, the above forms represent what is generally considered the limt of sulfur which combines with each of these alkali metals with formation of definite compounds.

When these sulfur saturated compounds are made with the sulfur derived from the fossil fuels, they can be thermally decomposed into lower sulfur content polysulfides of the alkali metals with elemental sulfur separating from this melt.

The temperatures required to decompose the various polysulfides are as follows from the saturated forms.

Potassium tetrasulfide —over 300° C

Potassium tri-sulfide — cannot be produced directly thermally

Potassium di-sulfide — over 850° C which decomposes the tetrasulfide

The mono-sulfides cannot be produced thermally.

Sodium tri-sulfide does not exist.

Sodium di-sulfide — 550° C

The existence of sodium pentasulfide is questionable and its production in the process is not preferred. Therefore, the tetra-sulfide is considered the sulfur saturated sodium form. At least two forms of sodium tetra-sulfide exist and one of these forms appears capable of forming a pentasulfide of definite chemical composition.

In melt condition, the potassium polysulfides are preferred to the sodium polysulfides. In aqueous solutions, the ability of potassium to gather sulfur is somewhat greater than that of sodium and the re-cycling of the polysulfides is much easier with potassium. With sodium, the sulfur is distilled from the melt at 550° C whereas the sulfur is molten at just over 300° with the potassium pentasulfide decomposition.

In aqueous solution, there is little difference between sodium and potassium in their ability to remove sulfur from the fossil fuels.

DISCLOSURE

Elemental sulfur is soluble in the alkali metal sulfides or polysulfides. Certain forms of sulfur combined in organic compounds are extracted and dissolved by these alkali metal sulfides. Such alkali metal sulfides or polysulfides enter into chemical combination with the elemental sulfur of the fossil fuels and also react with the sulfur from various organic sulfur-containing compounds present in the fossil fuels. The alkali metal sulfides or polysulfides also react with certain water-insoluble metal sulfides in some cases dissolve this insoluble metal sulfide and in others liberate the metal while acquiring the sulfur of this sulfide.

When insufficient sulfur is available to form the sulfur saturated polysulfide of the alkali metal, an intermediate polysulfide may be formed.

In general, the polysulfides are water soluble and stable in cold water but decompose in hot water. The potassium pentasulfide and the sodium tetrasulfide are stable in hot or cold water. The potassium pentasulfide is extremely soluble. In water, the mono-sulfides are largely or completely hydrolyzed to the alkali metal hydroxide and to the alkali metal hydrosulfide.

The stability of the sulfur saturated alkali metal sulfides permits them, when in water solution, to be heated when being evaporated prior to the thermal decomposition when in melt condition. When the aqueous solution of the sulfur saturated alkali metal polysulfide is evaporated to dryness, the temperatures are increased to 550° C for the sodium polysulfide and to just over 300° C for the potassium polysulfide to produce sodium di-sulfide and potassium tetrasulfide. The molten sulfur is separated from the potassium tetrasulfide melt but with the sodium di-sulfide, the sulfur is distilled off.

Hot water is not added to the intermediate sulfur content alkali metal polysulfides, nor is water added to a hot melt of these polysulfides. Should it be desirable to heat a solution of these intermediate polysulfides or to add water to their melt, sufficient sulfur can be added to produce the sulfur saturated polysulfide. A melt of the sulfur-saturated polysulfide can have water added to it without decomposition and the aqueous solution of the sulfur-saturated polysulfide can be heated without decomposition.

The fossil fuels should be in such a state of division to permit contact between the fossil fuel and the reagent polysulfides. In solid form, this is from −30 to −60 mesh or smaller. A larger size requires longer contact time.

The liquid fossil fuel should be dispersed in a manner to achieve the greatest possible contact between the fossil fuel and the polysulfide reagent.

When the alkali metal polysulfides are used in melt condition, a division between the low melting point polysulfide and the high melting point polysulfides is useful. The higher content polysulfide can not be made if the melting point of the original lower sulfur content polysulfide is above the decomposition point of the resulting higher sulfur content polysulfide.

When used in melt condition the sodium polysulfide range is much less than that of the potassium. Both sodium and potassium have mono-sulfides that can only be prepared by chemical reduction. Sodium di-sulfide has a melting point of over 445°C. Sodium tetra-sulfide has a melting point of 275°C and can be decomposed at 550° c. The polysulfides of both Na and K can dissolve almost limitless quantities of sulfur but above saturated point it will not form definite compounds. Sodium pentasulfide if it exists has a melting point of 251.6° C but the compound is too unstable to have a specific decomposition point. The decomposition of the sodium tetra-sulfide requires temperatures of 550° C and at this temperature the sulfur is distilled. This distilled sulfur is the sulfur lost by the tetrasulfide in becoming the di-sulfide. Additional sulfur can be dissolved in a melt of sodium tetrasulfide but whether this sulfur is in chemical combination or merely present in solution is questionable. Where the sulfur is in combined form in the fossil fuel the sodium tetrasulfide generally cannot remove such sulfur from its combined form.

The potassium sulfides and polysulfides present a complete range from the mono-sulfide to the pentasulfide. The pentasulfide can dissolve additional sulfur in aqueous solution or in melt condition, however, this excess sulfur must be in atomic or elemental form. The mono-sulfide has a melting point of 840° C, the di-sulfide a melting point of 470° C, the tri-sulfide a melting point of 252° C, the tetra-sulfide a melting point of 145° C and the pentasulfide a melting point of 206° C. The pentasulfide decomposes at 300° C, the tetrasulfide at 850° C, the tri-sulfide at 340° C.

When the sulfur saturated potassium pentasulfide is decomposed, the temperature of the decomposition determines the resulting polysulfide. At 870° C, the pentasulfide is almost completely decomposed into the di-sulfide and the sulfur differential between the pentasulfide and the di-sulfide is distilled off. At just over 300° C, potassium pentasulfide decomposes into potassium tetra-sulfide with some potassium tri-sulfide being also produced. When a temperature of just over 300° C is maintained, the sulfur is both insoluble and incapable of entering into chemical combination. This sulfur separates from the molten polysulfide and can be removed. The sulfur at 300° C and over, is below the boiling point of sulfur (444.6° C) and also is quite fluid. The sulfur becomes thick at from 160° to 260° C. (The melting point is 112°–119.5° C.). The sulfur formed upon cooling and after the separation from the pentasulfide is rhombic sulfur (alpha). The gamma (amorphous) sulfur can not be obtained from polysulfides. The molten polysulfides of potassium at temperatures below 300° C. seem to form the pentasulfide with acquired sulfur and then be decomposed back to the appropriate polysulfide consistent with the quantity of sulfur available. The tri-sulfide, tetra-sulfide of potassium having melting points below the decomposition point of the potassium pentasulfide. These are the most effective and preferred agents. The melting point of the di-sulfide is above the decomposition point of the tri-sulfide and the pentasulfide and the reaction in acquiring of sulfur by this polysulfide is much slower than with the higher sulfur content polysulfides.

When the polysulfides are used in aqueous solution, this range between the decomposition points and the melting points are of no importance. The only consideration is in the thermal decomposition of the higher sulfur content polysulfide to the desired lower sulfur content polysulfide.

Exposure to air of the aqueous solutions of these alkali metal sulfides or polysulfides results in the formation of some thio-sulfates and thionates by atmospheric oxidation. These thio-sulfates and the thionates are thermally decomposed (in dry state) to the appropriate sulfate and the corresponding polysulfide.

The mono-sulfides of these alkali metal sulfides can not be produced by thermal decomposition of the polysulfide forms, the mono-sulfide can be prepared by chemical reduction.

Coal is readily desulfurized with aqueous solutions of sodium di-sulfide or even the tetra-sulfide, of potassium mono-, di-, tri-, or tetrasulfides. The melts of these sodium and potassium sulfides provide no advantage over their use in aqueous solution in desulfurizing coal.

With the oils tested, potassium tetrasulfide gave the best results in lowering the sulfur content of these oils when the potassium tetrasulfide is melt condition at 150° C.

The process of the invention can be applied to natural gas containing sulfur and to flue gases. The treatment of flue gases after combustion of the fossil fuels presents a different problem in that the sulfur is essentially in the form of sulfur dioxide. In melt condition, the most efficient reduction of this sulfur dioxide was accomplished with potassium tetrasulfide because of its low melting point (145° C). In both aqueous solution and melt of the polysulfides, the sulfur dioxide, forms a mixture of relatively thermally unstable sulfites, thiosulfates, and thionates with appropriate quantities being converted to polysulfides.

The mono-sulfide of the alkali metals in aqueous solutions is hydrolyzed to the appropriate hydroxide and the corresponding hydrosulfide. The hydrosulfide is oxidized to the polysulfide with formation of water by atmospheric oxygen.

The thermal decomposition of the sulfites is:

$$4\ Na_2SO_3 + \text{heat} = Na_2S + 3\ Na_2SO_4$$

The decomposition of the thionates and thiosulfates are similar with some intermediate steps and also involving atmospheric oxygen.

All of the oxygen-sulfur forms with alkali metals are thermally unstable and form the sulfate with polysulfides also being formed. The polysulfides and sulfides of these alkali metals are not oxygen-sulfur combinations, and this oxygen-sulfur combination is introduced by treating sulfur di-oxide.

Treating the flue gases with an aqueous solution of the alkali metal sulfides will produce hydrogen sulfide gas when the intermediate polysulfides are formed due to their decomposition in hot water (the flue gases are hot). The hydrogen sulfide gas begins its decomposition into hydrogen and elemental sulfur at 310° C and the decomposition takes place at a more rapid rate above this temperature. The burning of the fossil fuel could supply sufficient heat to decompose the hydrogen sulfide. The reaction of the flue gases with the alkali metal sulfide produces mainly the sulfite, thiosulfate and thionates. The end product of their thermal decomposition is largely the thermally stable sulfate and the sulfate must be reduced with carbon (coal) with subsequent production of carbon monoxide. The carbon monoxide can be used as a fuel or in various chemical process.

PREPARATION OF REAGENTS

The polysulfides of the alkali metals can be prepared in various ways.

Hydrogen sulfide added to an aqueous solution of the hydroxide of the alkali metal produces the hydrosulfide. The aqueous solution of the hydrosulfide is oxidized by atmospheric oxygen to the hydroxide plus sulfur. This sulfur does not precipitate but combines with the alkali metal to form polysulfides.

The alkali metal hydroxides with sulfur added to them can be reacted with certain metal sulfides (such as size or lead) and this reaction produces polysulfides.

The sulfates of the alkali metal can be reduced to the sulfides with a form of carbon.

A solution of the alkali metal can be reacted with elemental sulfur and atmospheric oxidation to produce a thiosulfate and a polysulfide. Thermal decomposition of the thiosulfate produces additional polysulfide and the sulfate. This sulfate must be reduced to the sulfide thermally by reduction with carbon.

When a lower melting point polysulfide is desired, sufficient sulfur can be added to a melt or to an aqueous solution of the polysulfide to produce the polysulfide with the desired sulfur content.

UTILIZATION OF THE PROCESS

The coal was treated by aqueous solutions of the alkali metal sulfides and polysulfides. The reagent was coal-reduced sodium or potassium mono-sulfide. The concentration varied from a 1 to a 3% solution. The temperatures did not exceed 36° C. After the coal was reduced to from −30 to −60 mesh it was contacted with aqueous solution of the sodium or potassium sulfides or polysulfides. The total contact time was from 3 to 7 minutes. The coal was withdrawn from the polysulfide bath and washed with water to remove any polysulfide remaining on the surface of the coal particles. The wash water was continually evaporated to produce a concentration of polysulfides equivalent to that of the polysulfide bath which treated the coal. When the sulfide or polysulfide bath had acquired sufficient sulfur from the coal to be considered sulfur saturated, the aqueous solution was evaporated to dryness. Saturation for the potassium pentasulfide was recognized by its orange color and was decomposed at 340° C to a mixture of potassium tetrasulfide (which predominated) and of potassium tri-sulfide. Sulfur separated from the melt at the 340° C and was run off and separated from the potassium polysulfide melt. This potassium polysulfide was ready for dissolving in more water to form the reagent for treating additional coal. The sodium polysulfide (having a sulfur content between the definite tetrasulfide and the problematical pentasulfide) was decomposed at 550° C. The sulfur was distilled and collected under water to prevent its ignition. The melt became solid as the sulfur was removed as the resulting polysulfide had a melting point above that of the 550° employed. The solids were dissolved in water and the resulting solution was used to treat additional coal.

The polysulfide solutions were filtered prior to their being evaporated to dryness before the thermal decomposition of the higher sulfur content polysulfides.

In the case of the oil the same was sprayed into the bottom of 6 foot high tubes having a diameter of 1 inch. The lighter (specific gravity) oil rose thru the pipe and was collected at the top. The melt polysulfide because of its low melting point was potassium tetrasulfide. The tube had a uniform temperature of 150° C. Each subdroplet of oil required from 3 to 5 seconds to traverse the 6 feet of pipe. The other polysulfides of potassium and all those of sodium required a temperature for melting the polysulfides that was in excess of the flash point of the oil. The results of desulfurizing the oil were superior with the potassium tetrasulfide to those of passing the oil thru an aqueous solution of the various polysulfides of the alkali metals.

Aqueous solutions of sodium sulfide, sodium di-sulfide, potassium mono-sulfide, potassium di-sulfide, potassium tri-sulfide, and potassium tetra-sulfide in concentrations from 1 to 8% were treated with oil. The sulfides and polysulfides were placed in tubes 6 feet high and with a 1 inch diameter. These tests were run at under 36° C. There was a good deal of sulfur removal but in no case did it equal the sulfur removal of the melt potassium tetrasulfide. The treatment time was from 2 to 4 seconds with the oil sprayed into the bottom of the tubes in droplets.

The aqueous solution of the polysulfides had to be evaporated to dryness prior to the thermal decomposition of the polysulfides. The melt potassium tetrasulfide converted to the pentasulfide while the acquired oil sulfur was treated thermally in the tube by elevating the temperature to 340° C and collecting the sulfur at the bottom of the tube. All fossil fuel was removed prior to this elevation of temperature.

Treatment of the Sulfur Saturated Polysulfides for Reduction of Sulfur Content and Their Re-Use in the Process When the desulfurization of the fossil fuels is effected with an aqueous solution of alkali metal polysulfides, the aqueous solution is evaporated to dryness after it has formed a sulfur saturated form of the polysulfide or dissolved considerable sulfur in excess of combined sulfur.

A melt of polysulfides of the alkali metals is ready for thermal decomposition as formed.

Both the melt and the aqueous solution should be filtered to remove solid materials prior to either the evaporation of the aqueous solution or the thermal decomposition of the melt.

The saturated polysulfide of potassium is decomposed at either just over 300° C or at 870° C. At 300° C, the tetra-sulfide and some tri-sulfide are formed by the loss of elemental sulfur which is neither soluble in themelt at this temperature nor can it reform the pentasulfide. The sulfur has somewhat greater specific gravity than does the polysulfide melt and can be run off in a very fluid state. Sulfur melts at from 112° to 119° C. Sulfur becomes thick between 160° and 260° C and above 260° regains its fuluidity. At 444.6° C sulfur boils. When the temperature is just over 300° C the sulfur can be run off in a fluid state.

When a temperature of 870° C is employed the elemental sulfur is distilled. The sulfur is gaseous state is not permitted to contact air or it would form sulfur oxides in combustion. At 870° C the polysulfide is almost entirely converted to elemental sulfur and to the disulfide. The tetra-sulfide is stable to 850° C and to break down the tetra-sulfide a temperature exceeding 870° C must be used. The figure of 870° C is chosen because this is the melting point of the mono-sulfide of potassium.

The mixture of the tri-sulfide and tetra-sulfide of potassium is ready for re-use in extracting additional sulfur from additional fossil fuels in either an aqueous solution or in melt condition. This mixture melts at 145° C.

The di-sulfide of potassium is ready for re-use generally in aqueous solution. The melting point of the di-sulfide is above the decomposition point of all the polysulfides having a greater sulfur content than the di-sulfide of potassium A very thorough cleaning and preparation of the potassium pentasulfide can be made by adding some sulfur to the melt and then adding water to the melt. The additional sulfur guarantees that the polysulfide is the pentasulfide. Filtration will then remove almost all impurities which have accumulated in the pentasulfide. The regular evaporation and thermal decomposition follow this step.

The sodium sulfur-saturated compound can be thermally decomposed at 550° C. However the disulfide which is the product of this decomposition has a melting point of around 445° C. This is lower than the published figures and means that additional sulfur remains in the melt over that required to produce the sulfur content equivalent to the di-sulfide of sodium.

With the sodium sulfur saturated polysulfide thermal decomposition, the sulfur is distilled off and must be prevented from igniting at the temperatures employed. The sulfur can be condensed under water, filtered and recovered.

The sulfur form recovered from these thermal decompositions is the alpha form. The beta form exists in a narrow temperature range just over the melting point of sulfur. The gamma form cannot be recovered from polysulfides by any means.

The invention is further illustrated by the following working examples.

WORKING EXAMPLES

Six coal samples of 10 pounds each were used. The coals were from different areas of the United States.

The average sulfur content was (a) 3.2%, (b) 1.1%, (c) 2.0%, (d) 2.6%, (e) 4.4%, (f) 0.8%.

Six 10 pound samples were tested with potassium di-sulfide an additional six 10 pound samples were tested with sodium disulfide. Yet another six 10 pound samples were tested with potassium tetra-sulfide.

The coal was ground, and −60 mesh material made up the 10 pound samples.

Sodium di-sulfide was made up in a solution of the following percentages. The weight of the sodium di-sulfide and all the polysulfides are based on the amounts which would react with the assay percentage of sulfur in the coal. This quantity was made up in water for a total weight of polysulfide and water of 10 pounds.

sample a. — 0.5472 lbs of sodium disulfide to 10 lbs of water to make a 5.472% solution.
sample b. — 0.1881 lbs of sodium disulfide to 10 lbs of water to make a 1.881% solution.
sample c. — 0.342 lbs of sodium disulfide to 10 lbs of water to make a 3.42% solution.
sample d. — 0.4446 lbs of sodium disulfide to 10 lbs. of water to make a 4.446% solution.
sample e. 0.7524 lbs of sodium disulfide to 10 lbs. of water to make a 7.524% solution.
sample f. — 0.1368 lbs of sodium disulfide to 10 lbs of water to make a 1.368% solution.

It was calculated that the above reaction with the percentage of sulfur in each coal sample would produce the sodium tetrasulfide.

The reagents were dissolved in cold water and no heat was supplied during the contact with the coal. The contact time was 4 minutes on a vibrating plate which was meant to simulate the coal's passage thru the sodium disulfide solutions.

Following a 4 minute exposure to the reagents the coal was water washed. The coal was dried and assays showed the following percentages of sulfur remained in the coal:

| Original | After treatment | Percent sulfur removed |
|---|---|---|
| a) 3.2% | 0.4% | 87.5% |
| b) 1.1% | 0.04% | 96.36% |
| c) 2.0% | 0.5% | 75% |
| d) 2.6% | 0.3% | 88.46% |
| e) 4.4% | 0.11% | 95.45% |
| f) 0.8% | 0.2% | 75.0% |

EXAMPLE 2

To illustrate the use of potassium di-sulfide, the following solutions of potassium di-sulfide were made up in cold water. The total weight of the water and the potassium di-sulfide was 10 pounds.

sample a. 0.4704 lbs of potassium disulfide to 10 lbs of water to make a 4.704% solution.
sample b. —0.1617 lbs of potassium disulfide to 10 lbs of water to make a 1.617% solution.
sample c. —0.294 lbs of potassium disulfide to 10 lbs of water to make a 2.94% solution.
sample d. —0.3381 lbs of potassium disulfide to 10 lbs of water to make a 3.381% solution.
sample e. —0.6468 lbs of potassium disulfide to 10 lbs of water to make a 6.468% solution.
sample f. —0.1176 lbs of potassium disulfide to 10 lbs of water to make a 1.176% solution.

These weights were calculated to produce potassium pentasulfide with the total available sulfur in the samples of coal. The treatment, time, and method were as for the sodium disulfide. The results were:

| Original | After treatment | Percent sulfur removed |
|---|---|---|
| a) 3.2% | 0.46% | 85.62% |
| b) 1.1% | 0.3% | 72.72% |
| c) 2.0% | 0.35% | 82.5% |
| d) 2.6% | 0.47% | 81.92% |
| e) 4.4% | 0.54% | 87.72% |
| f) 0.8% | 0.15% | 81.25% |

WORKING EXAMPLE 3

Potassium tetra-sulfide was made up in the following percentage solutions for use in treating 10 pound samples of the coal under identical conditions as in Examples 1 and 2. The principal difference was that the potassium tetra-sulfide could acquire only one sulfur per one potassium tetra-sulfide whereas the sodium di sulfide could acquire 2 sulfurs, and the potassium di-sulfide could acquire 3 sulfurs. Therefore the potassium tetra-sulfide was made up in a total weight of 30 pounds of combined potassium tetra-sulfide and water.

sample a. —2.0608 lbs of potassium tetra-sulfide to 30 lbs of water to make a 6.86% solution
sample b. —0.7084 lbs of potassium tetra-sulfide to 30 lbs of water to make a 2.36% solution
sample c. —1.288 lbs of potassium tetra-sulfide to 30 lbs of water to make 4.29% solution
sample d. —1.6744 lbs of potassium tetra-sulfide to 30 lbs of water to make a 5.58% solution
sample e. —2.8336 lbs of potassium tetra-sulfide to 30 lbs of water to make a 9.44% solution
sample f. —0.5152 lbs of potassium tetra-sulfide to 30 lbs of water to make a 1.71% solution The results were as follows:

| Original | After treatment | Percent sulfur removed |
|---|---|---|
| a) 3.2% | 0.65% | 79.68% |
| b) 1.1% | 0.55% | 50% |
| c) 2.0% | 0.76% | 62% |
| d) 2.6% | 0.51% | 80.38% |
| e) 4.4% | 0.62% | 85.9% |
| f) 0.8% | 0.005% | 99.37% |

EXAMPLE 3

Repeating the above, the samples of the coal were treated the wash water and the polysulfide bath in which the coal was treated were filtered and the filtrates evaporated to dryness.

The temperature was elevated 1000° C (above that which was necessary) for the sodium tetra-sulfide. The sulfur condensed in the tank. The amount of sulfur recovered approximated that lost by the treated coal. The di-sulfide of sodium was reconstituted and used to remove sulfur from additonal coal samples.

EXAMPLE 4

Repeating the procedure of Examples 1 and 2 formed a compound between potassium tetra-sulfide and potassium pentasulfide. This was decomposed at 870° C into sulfur (which distilled off) and reconstituted potassium di-sulfide. The collection of the sulfur was as with the sodium di-sulfide.

EXAMPLE 5

Repeating the procedure of Examples 1 and 2 potassium tetra-sulfide formed mainly potassium pentasulfide. The pentasulfide was heated to 340° C and the sulfur separated from the pentasulfide as the tetrasulfide was formed. There were also lower sulfur content polysulfides formed but the main polysulfide was the tetrasulfide. The separated sulfur collected at the bottom of the container and was drained off. The potassium tetra-sulfide so reconstituted was used to treat additional coal.

EXAMPLE 6

The quantities necessary to treat 1 ton of each coal are the following (in lbs. of polysulfide).

| Potassium tetrasulfide | Potassium di-sulfide | Sodium disulfide |
|---|---|---|
| a) 412.16 | a) 94.08 | a) 109.44 |
| b) 141.68 | b) 32.34 | b) 37.62 |
| c) 257.6 | c) 58.8 | c) 68.4 |
| d) 334.88 | d) 67.62 | d) 88.92 |
| e) 566.72 | e) 129.36 | e) 150.48 |
| f) 103.04 | f) 23.52 | f) 27.36 |

EXAMPLE 7

Desulfurization of crude oil was also done in aqueous solutions of sodium di-sulfide and of potassium di-sulfide. A melt of potassium tetra-sulfide was also used.

A crude oil having a sulfur content of 2.23% was used with both sodium di-sulfide and potassium di-sulfide in aqueous solutions of 12% concentrations. These tests were done at from 60° to 75° F.

A high speed low torque blade agitator was mounted above a tube with a 1 and ½ inch inner diameter. The agitator blade was 1 and ¼ inch long and was mounted on a 13 inch stem. The stem passed thru two bracings (wire) to prevent wobbling of the agitator with subsequent striking of the tube wall. There was a 12 inch depth between the bottom of the agitator and the overflow at the top, with an additional 1 inch to the motor of the agitator. The tube was filled with the 12% sodium disulfide solution or with 12% potassium disulfide aqueous solution. The oil entered under pressure thru a nozzle and plunger arrangement 3 inches below the agitator on to the agitator. The oil having a specific gravity less than that of the aqeuous solution of the di-sulfides rose thru the solution. When the oil encountered the agitator blade it was finely dispersed in minute droplets thruout the aqueous solution. The flow of the oil into the chamber was manually regulated to produde considerable coalescing of these droplets into larger drops or a film at the top of the tube where the oil overflowed. Collecting the oil after the run off at the top permitted further separation of the aqueous solution and the oil.

This treatment approximated 5 seconds per drop of oil from the time the oil entered the chamber as an aqueous solution till it overflowed at the top.

In cases where a melt is used, when the melt shows signs of setting up (solidifying) the oil injection was stopped and the oil present in the tube allowed to rise to the surface. This oil was removed. The melt was raised to 340° C (without its removal from the tube). The decomposition of the pentasulfide occured in the tube and the sulfur collected at the bottom and was run off thru a stopcock. This reconstituted potassium tetrasulfide was ready to acquire more sulfur from additional oil.

After several reconstitutions of the tetra-sulfide, the polysulfide can be cleaned by adding sufficient sulfur to insure that the polysulfide is the pentasulfide. This pentasulfide is added to water (hot or cold) and made into a very concentrated solution (50–60%). The solution is filtered, and the water is evaporated from the clear filtrate. The pentasulfide is thermally decomposed to the lower sulfur content polysulfide and is ready for re-use.

The thermal decomposition of sulfur is of two varieties. At elevated temperatures above 444.6° C the sulfur is distilled off. This sulfur is condensed. One rapid method of condensation is piping the vaporous sulfur under cold water.

The other decompositions is at temperatures under the boiling point of sulfur wherein the sulfur is collected at temperatures above 260° C and below 444.6° C. Appropriate temperature ranges result in molten sulfur which separates at this maintained temperature from the polysulfide with the creation of intermediate sulfur content polysulfides with low melting points.

The formation of the higher sulfur content polysulfides require that the melting point of the melting point of the polysulfide used originally in forming a melt is below the decomposition point (thermal) of the formed polysulfide. Thermal decomposition is a reverse of this, the polysulfide with lower sulfur content derived from a higher sulfur content polysulfide must have a melting point above the decomposition temperature of the polysulfide being decomposed.

The results of the sodium di-sulfide treatment showed a sulfur reduction to 0.5% sulfur content from the original 2.23%.

The potassium di-sulfide treatment left the oil with a sulfur content of 0.6% sulfur from the original 2.23% content.

10 gallons of the crude oil yielded 457 grams of sulfur with sodium di-sulfide solution, and 383.45 grams of sulfur with the potassium di-sulfide solution. This sulfur represents the sulfur acquired by the two di-sulfides in forming higher content polysulfides. Sodium di-sulfide acquired 87% of the oil's sulfur while potassium di-sulfide acquired 73% of the oil's sulfur.

851.26 grams of potassium di-sulfate as 12% by weight of an aqueous solution removed 383.45 grams of sulfur by combining with this sulfur to form potassium tetra-sulfide from 10 gallons of 2.23% sulfur content oil.

A total of 15.66 lbs of water was used which with the potassium di-sulfide made for 15.66 lbs total 1.8791 lbs of this total 15.66 lbs was the potassium di-sulfide's weight.

864 grams of sodium di-sulfide as a 12% solution by weight removed 457 grams of sulfur from 10 gallons of crude oil having a sulfur content of 2.23%. This solution weight was 15.8876 lbs of which 1.907 lbs was sodium di-sulfide.

200 grams of sodium di-sulfide as a 12% solution by weight removed 457 grams of sulfur from 10 gallons of crude oil having a sulfur content of 2.23%. This solution weight was 15.8876 lbs of which 1.907 lbs was sodium di-sulfide.

200 grams of elemental sulfur was added to the solutions of the tetra-sulfidesafter the separation from the oil. This insured that the polysulfides were in combined sulfur saturated form which permitted boiling the solutions to evaporate them to dryness. The aqueous solutions were filtered prior to boiling after the addition of the sulfur.

The potassium polysulfide was decomposed at 870° C and the sulfur distilled off. The sulfur was condensed under water by a tube leaving from the distillation chamber to under the water.

The sodium tetra-sulfide was also decomposed but at a higher temperature — approaching 1000° C. The sulfur was condensed as with the potassium polysulfide decomposition.

EXAMPLE 8

The decomposed lower sulfur content polysulfides were used to treat additional oil with results similar to those reported.

This time the potassium polysulfide was decomposed at 340° C and a mix of potassium tri- and tetrasulfides obtained. The sulfur did not distill off at this temperature and was separated at 340° C by running off the fluid molten sulfur.

This potassium tri- and tetrasulfide was used to treat a 5 gallon quantity of oil. The ability to acquire sulfur was approximately halved by using a higher sulfur content polysulfide. The potassium di-sulfide could have been taken to the pentasulfide state with aquisition of 50% additonal sulfur to what the results were as reported above. This additional sulfur would be recovered from additional oil as the percent of recovery is remarkably constant. This aqeuous 12% solution of the tetrasulfide of potassium recovered 71% of the assayed oil content of the oil treated.

The aqueous solutions of the polysulfides are kept under an inert nitrogen atmosphere to lessen the oxidation of the polysulfides or sulfides with formation of the thio-sulfates. This precaution may not be necessary, but the oxidation of the monosulfides produce polysulfides and the thiosulfates. Whether the polysulfides so oxidize is not certain.

EXAMPLE 9

Potassium tetra-sulfide with a melting point of 145° C was used for this example.

A tube 1 inch in diameter and 6 feet high was the apparatus used in this example. The tube was maintained at 150° C and filled with potassium tetra-sulfide. The oil was injected at the bottom of the tube by a plunger and nozzle arrangement. The nozzle was ¼ inch from a plate against which the injected oil was sprayed as an attempt to disperse the drops into as fine as state as possible.

The oil rose thru the tube, being lighter than the melt. The agitator was run at a reduced speed and probably did not aid in dispersing the drops.

An oil with a 2% sulfur content was injected into the tube. It was estimated that each droplet traversed the tube in from 7–10 seconds.

The oil as collected at the top of the tube in a nitrogen atmosphere contained less than 0.1% sulfur.

Each 2,355.6 grams of this oil contained 47.1 grams of sulfate, 303.2 grams of molten potassium tetrasulfide could acquire this 47.1 grams of sulfur to form potassium pentasulfide.

58.6 gallons of this oil (58.6 × 2,355.6 grams) was necessary to convert the full tube containing 0.3928 cubic feet of 1.6 specific gravity molten potassium tetrasulfide weighing 39.234 lbs. (17.772.8 grams) to potassium pentasulfide. 2,760.06 grams of sulfur were in this quantity of this oil and 2,622 grams of this sulfur were acquire by the tetrasulfide. This was 95% of the sulfur in the oil acquired by the tetrasulfide.

The potassium pentasulfide has a melting point of 206° C and the temperature employed was 150° C. The potassium pentasulfide showed considerable solubility in the fused potassium tetrasulfide. When the melt showed signs of setting up (solidifying) the oil injection was stopped and the oil present in the tube allowed to rise to the surface. This oil was removed. The melt was raised to 340° C (without its removal from the tube). The decomposition of the pentasulfide occured in the tube and the sulfur collected at the bottom and was run off through a stopcock. This reconstituted potassium tetrasulfide was ready to acquire more sulfur from additional oil.

After several reconstitutions of the tetra-sulfide, the polysulfide can be cleaned by adding sufficient sulfur to insure that the polysulfide is the pentasulfide. This pentasulfide is added to water (hot or cold) and made into a very concentrated solution (50–60%), this solution is filtered, the water is evaporated from the clear filtrate, the pentasulfide is thermally decomposed to the lower sulfur content polysulfide and is ready for re-use.

It will be understood by those skilled in the art that because of the temperatures employed in the present process, the same is fully compatible with normal oil refining operations and can be integrated therewith. Similarly, it will be appreciated that the present process can be used generally with any fuel which does not require hydrogenation. For example, in the case of tar sands, the lower end of the fractions are soluble with polysulfides.

While the present invention has been illustrated mainly with respect to the use of sulfides and polysulfides of sodium and potassium, it will be understood that the polysulfides of rubidium and cesium are also operative.

What is claimed is:

1. A process for desulfurizing a fuel of the group of coal, tar sands, (flue gases produced by the combustion thereof) and natural gases, which comprises reacting said fuel prior to combustion thereof with at least one non-volatile, unsaturated sulfur compound of an alkali metal of the group of sodium, potassium, rubidium and cesium or with a hydrogen polysulfide at a temperature sufficient to form a corresponding polysulfide to higher sulfur content than said unsaturated compound, and separating a fuel of reduced sulfur content from said polysulfide.

2. The process of claim 1, wherein said polysulfide is thermally decomposed into sulfur and a corresponding polysulfide of lower sulfur content, which is recycled.

3. The process of claim 1, wherein said unsaturated sulfur compound is used in an amount at least stoichiometrically equal to the amount of sulfur estimated in said fuel.

4. The process of claim 1, comprising finely dividing coal to a particle size of around −30 to −60 mesh and contacting said coal with an aqueous solution of said sulfur compound.

5. The process of claim 1, comprising using said sulfur compound in the form of an aqueous solution containing from about 1 to about 12% sulfide, contacting said fuel with said solution at a temperature not above 36° C., separating said solution now containing said polysulfide from said fuel, evaporating said solution to dryness and thermally decomposing said polysulfide to form said unsaturated sulfur compound for reuse in said process.

6. The process of claim 1, wherein treated coal is washed with water to remove any polysulfide therefrom and the resulting wash water is evaporated to regenerate said sulfur compound.

7. A process for desulfurizing petroleum oils which comprises passing said oils upwardly through a vertical contacting zone containing a melt of potassium tetrasulfide at a temperature above ambient temperature; collecting an oil of reduced sulfur content at the top of said zone, and leaving behind in said zone the corresponding pentasulfide.

8. The process of claim 7 wherein said contacting zone is at a temperature of around 150° C.

9. The process of claim 7, including the further step of heating said zone above the decomposition temperature of said pentasulfide and of collecting the sulfur thus formed at the bottom of said zone.

10. The process of claim 1, wherein said sulfur compound is used in the form of a melt.

11. The process of claim 1 comprising passing said fuel through an elongated, vertical, contacting zone containing said sulfur compound; collecting said fuel with reduced sulfur content at one end of said zone and leaving behind at the other end of said zone a corresponding polysulfide of higher sulfur content than said sulfur compound.

* * * * *